United States Patent [19]

Lotis

[11] 4,047,259

[45] Sept. 13, 1977

[54] BODY WASHING APPARATUS

[76] Inventor: Leonard L. Lotis, 9115 Ridge Blvd., Brooklyn, N.Y. 11209

[21] Appl. No.: 688,119

[22] Filed: May 20, 1976

[51] Int. Cl.[2] ..... A47K 7/03

[52] U.S. Cl. ..... 15/104.92; 4/184; 24/73 VA; 248/206 R; 401/201; 15/244 B

[58] Field of Search ..... 15/104.92, 244 B, 244 C; 4/158, 184; 24/73 VA, DIG. 18; 248/206 R; 401/42, 201; 128/65

[56] References Cited

U.S. PATENT DOCUMENTS

| | | | |
|---|---|---|---|
| 2,070,313 | 2/1937 | Pieper | 401/201 |
| 2,466,502 | 4/1949 | Stiller | 248/206 R X |
| 2,588,773 | 3/1952 | Smith | 401/201 |
| 3,099,032 | 7/1963 | Webb | 401/8 |
| 3,426,464 | 2/1969 | Mezey | 401/201 |

FOREIGN PATENT DOCUMENTS

| | | | |
|---|---|---|---|
| 970,648 | 9/1964 | United Kingdom | 40/620 |

*Primary Examiner*—Daniel Blum
*Attorney, Agent, or Firm*—Robert D. Farkas

[57] ABSTRACT

This disclosure pertains to a flexible rubber-like mat having a plurality of suction cups affixed to one lateral surface thereof. The other lateral surface is substantially covered with a loose pile fabric-like material adapted to be releasingly engaged by one surface of a flexible soap containing apparatus. The plastic gripping surface of the flexible soap container is adapted with a multiplicity of multi-directional material grasping fingers. The remainder of the container is fabricated from porous sponge-like material enabling the soap within to be fluidly communicated with the exterior porous surfaces of the container. The mat may be installed on a wall or on the interior surfaces of a bathtub providing a convenient storage location for the soap container and utility as a washing aid.

4 Claims, 7 Drawing Figures

FIG.1
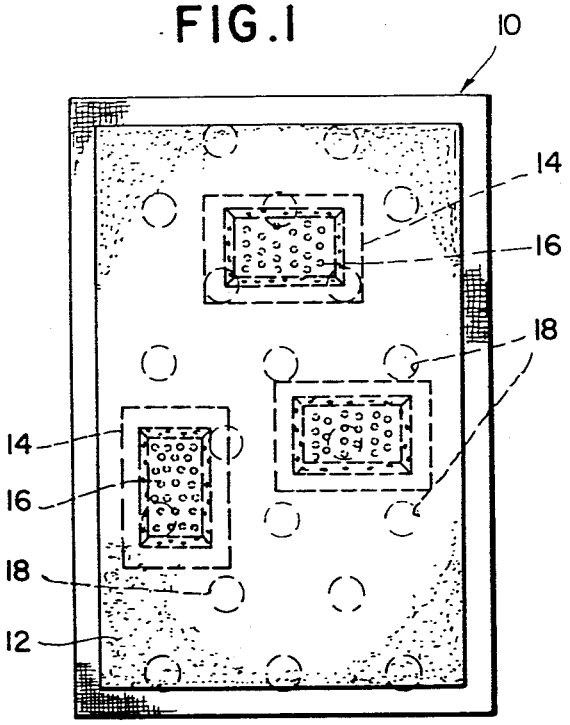
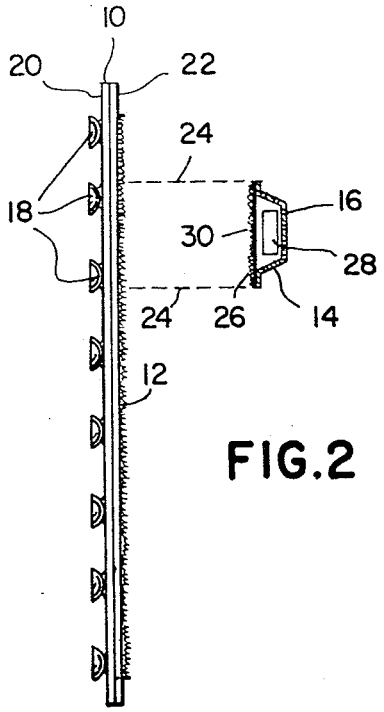
FIG.2
FIG.3
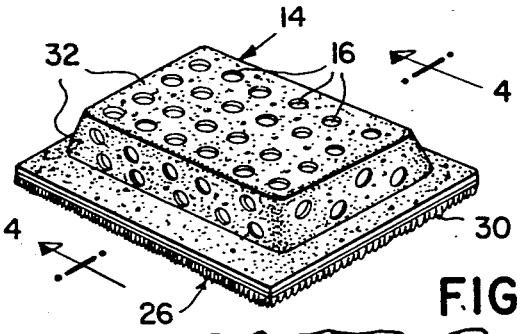
FIG.6
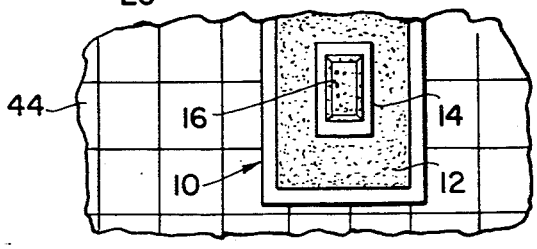
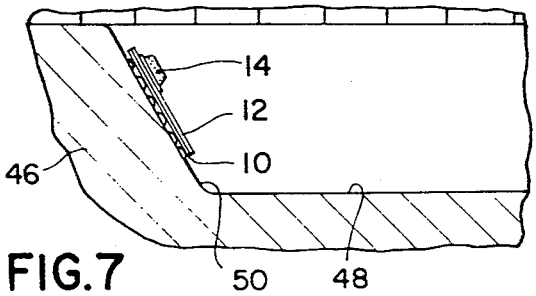
FIG.7
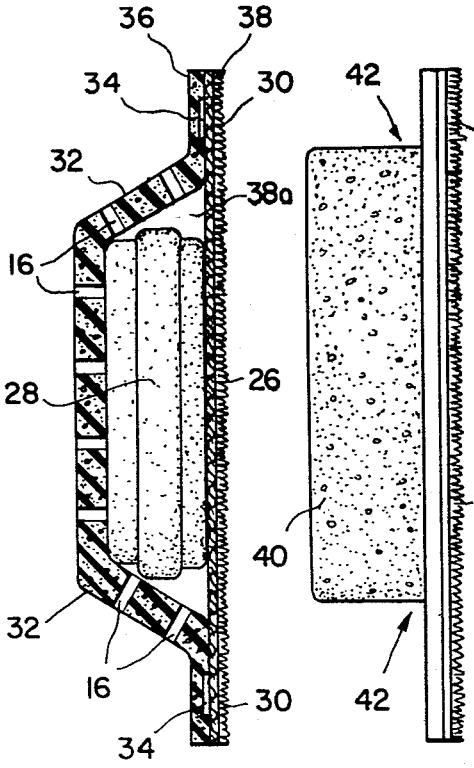
FIG.4
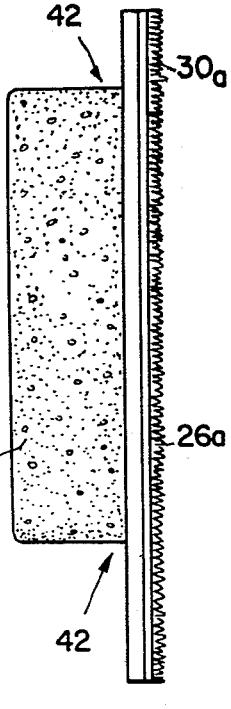
FIG.5

BODY WASHING APPARATUS

BACKGROUND OF THE INVENTION

1. The Field of the Invention

This invention relates to bathroom aids and more particularly to that class of device utilized to releasingly engage soap containers.

2. Description of the Prior Art

The prior art abounds with apparatus utilizing suction cups to provide mounting for a surface intended for use as a back-scrubber. U.S. Pat. No. 3,040,337, issued on June 26, 1962 to H.K. Fjelstad, teaches a scrubbing surface affixed to a bathtub utilizing suction cups therefore. U.S. Pat. No. 1,639,366 issued on Aug. 16, 1927 to W.M. Brown, discloses a rigid frame releasingly affixed to a smooth surface with the aid of a plurality of suction cups. A bathbrush is held within the frame and may be removed therefrom at the will of the user. U.S. Pat. No. 3,750,226, issued on Aug. 7, 1973 to R. W. Morgan, discloses a T-shaped cleaning and massaging device adapted for mounting on the walls of a shower stall which may be quickly re-positioned thereon by the plurality of suction cups utilized in the fastening process. All of the aforementioned inventions suffer the common deficiency of failing to provide a convenient location for the mounting of a soap container which can be used as an adjunct to a scrubbing operation in which the mounting surface is utilized in the dual capacity as a scrubber and as a soap container holder.

SUMMARY OF THE INVENTION

A primary object of the present invention is to provide a back scrubbing device having an exposed surface which serves the dual function of providing a flexible fabric-like construction which may be easily soaped and which may be utilized to support a soap container at various locations thereon.

Another object is to provide a porous flexible soap container whose mounting surface is compatible with releasable engagement with a fabric-like surface.

Still another object is to provide a soap container which can apply soap to the body of the user manually or when mounted on the soap container holding mat.

Yet another object is to provide a back scrubbing device which may be conveniently positioned and relocated at the will of the user upon rigid surfaces, utilizing a plurality of suction cups therefore.

These objects, as well as other objects of the present invention, will become more readily apparent after reading the following description of the accompanying drawings.

BRIEF DESCRIPTION OF THE DRAWINGS

FIG. 1 is a front elevation view of the instant invention showing the soap container at various locations thereon.

FIG. 2 is a side elevation view of the instant invention showing a soap container displaced outwardly from a mounting position from the scrubbing mat.

FIG. 3 illustrates a perspective view of the soap container.

FIG. 4 is a cross-sectional view taken through lines 4—4, as viewed in the direction of arrows 4—4, of the embodiment illustrated in FIG. 3, showing the soap container and a bar of soap contained therein.

FIG. 5 is a side elevation view of a spongelike body washing implement intended for mounting on the mat illustrated in FIG. 2.

FIG. 6 is a partial elevation view of a tiled wall supporting the instant invention.

FIG. 7 is a partial cross-sectional view of a bathtub providing support for the instant invention.

DESCRIPTION OF THE PREFERRED EMBODIMENT

The structure and method of fabrication of the present invention is applicable to a rubberlike rectangular mat whose rearmost surface is provided with a plurality of suction cups. The open mouth portions of the cups reside in a plane extending outwardly and parallel to the rearmost surface of the rubber mat. The front most surface of the mat is substantially covered with a fabric-like material whose construction includes a multiplicity of cut pile ends extending at various heights from the nap of the fabric. The fabric-like material may be characterized as one of the joining elements commercially denoted in the "Velcro" joining process.

A container is provided having a cavity. Five sides of the cavity are fabricated from a plastic foam-like material adapted with a plurality of pores or ports communicating from the interior of the cavity to the outermost surfaces of the five sides. The outermost surface of the sixth side is adapted with the other mating component utilized in the "Velcro" joining system, comprising a multiplicity of plastic filaments extending outwardly from the sixth side in diverse directions and having hook-like shapes at the free ends thereof. The container formed by the six sides may be opened so as to permit soap, in bar form, to be secured therein, by opening the surface intermediate one or more of the five sides, at the juncture with the sixth side, utilizing snap fasteners therefore.

In similar fashion, a solid three dimensional shaped scrubbing device is provided, having one lateral surface thereof adapted with the plastic "Velcro" joining element, for use as a scrubbing tool in either the manual hand-held position or when engaged upon the material-like surface of the suction cup held mat.

Now referring to the Figures, and more particularly to the embodiment illustrated in FIG. 1 showing a rectangular mat 10 upon which is secured a fabric-sheet surface 12. Soap containers 14 are shown secured at various locations on sheet 12. Holes 16 communicate with soap within soap containers 14.

FIG. 2 illustrates suction cups 18 fastened to the rearmost surface 20 of rectangular mat 10. Fabric-like material 12 is shown extending outwardly from the frontmost surface 22 of mat 10. Soap container 14 is illustrated removed and displaced from fabric surface 12 along dotted lines 24. The rearmost surface 26 of soap container 14 is adapted with a plurality of plastic gripping fingers 30, intended to grasp fabric surface 12. Pores 16 communicate to soap bar 28.

FIG. 3 illustrates soap container 14 comprising a porous foam-like material 32 through which ducts 16 pass. A container of soap, not shown, is confined within the cavity located within porous foam-like sides 32. Plastic gripping fingers 30 extend downwardly from the rearmost side 26.

FIG. 4 illustrates soap bar 28 confined within sides 32. Snap fastener at 34 allows edge 36, of side 32, to separate from edge 38 so as to permit the introduction and removal of soap 28 from cavity 38 formed by sides 32.

Plastic gripping fingers 30 extend outwardly from rearmost surface 26.

FIG. 5 illustrates a spongelike material 40 fixedly secured to the frontmost surface 42. The rearmost surface 26a is similarly equipped with plastic gripping fingers 30A. Spongelike material 40, fastened to scrubbing device 42, may be utilized as a scrubbing tool which, unlike soap container 14, shown in FIG. 3, has body scrubbing utility without acting as a soap sud dispenser.

FIG. 6 illustrates wall 44 to which rectangular mat 10 may be removably affixed, utilizing the suction cups 18, shown in FIG. 2, therefore. Soap container 14 is shown mounted on fabric-like surface 12.

FIG. 7 illustrates a cross-sectional view of a portion of a bathtub 46 to which is affixed rectangular mat 10. Surface 48 represents the interior bottommost surface of the tub, whilst surface 50 represents the interior backrest portion of the tub. Soap container 14 is illustrated mounted on fabric surface 12.

One of the advantages is to provide a back scrubbing device having an exposed surface which serves the dual function of providing a flexible fabric-like construction which may be easily soaped and which may be utilized to support a soap container at various locations thereon.

Another advantage is to provide a porous flexible soap container whose mounting surface is compatible with releasable engagement with a fabric-like surface.

Still another advantage is to provide a soap container which can apply soap to the body of the user manually or when mounted on the soap container holding mat.

Yet another advantage is to provide a back scrubbing device which may be conveniently positioned and relocated at the will of the user upon rigid surfaces, utilizing a plurality of suction cups therefore.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

I claim:

1. A body washing apparatus comprising a flexible mat, first fastening means to removably secure a first lateral surface of said flexible mat to a mounting surface, a porous flexible soap container, second fastening means to removably secure said soap container to said mat, soap introducing means for selectively opening and closing said flexible soap container for the selective introduction and removal of a bar of soap therein, wherein said first fastening means includes a plurality of suction cups, said plurality of said suction cups fixedly secured to said first lateral surface, the open mouth portion of each of said plurality of suction cups residing in a plane, said plane being disposed outwardly from and parallel with said first lateral surface, wherein said second fastening means comprises a fabric material, said fabric material being disposed outwardly on a second lateral surface of said mat, said second lateral surface being disposed on a side opposite to said first lateral surface of said mat, a gripping means on a surface of said soap container, said gripping means being fabricated from a plastic material, said second fastening means utilizing said plastic material having a plurality of fingers extending outwardly from said soap container, the free ends of said fingers being disposed in diverse directions, said free ends for releasably grasping said fabric material.

2. The body washing apparatus as claimed in claim 1 wherein said soap container comprises a housing, said housing being fabricated from a porous sponge-like material, a plurality of ducts, a cavity within said housing, said plurality of ducts leading from said cavity to an exterior surface of said housing, said second fastening means utilizing one wall of said housing having a plurality of fingers extending outwardly from said one wall, the free ends of said fingers being disposed in diverse directions, said free ends for releasably grasping said mat.

3. The body washing apparatus as claimed in claim 1 further comprising a scrubbing apparatus, said scrubber having a sponge-like pad fastening means on one side of said pad having a plurality of fingers extending outwardly from said one side, the free ends of said fingers being disposed in diverse directions, said free ends for releasably grasping said mat.

4. The body washing apparatus as claimed in claim 2 wherein said soap introducing means comprising an opening in said housing, said opening leading from said cavity to the exterior of said housing, snap fastening means for manual closure of said opening, said bar of soap being disposed through said opening and into said cavity.

* * * * *